United States Patent [19]

Abendroth et al.

[11] Patent Number: 4,852,488

[45] Date of Patent: Aug. 1, 1989

[54] SHEET TRANSFER DRUM FOR A PRINTING PRESS

[75] Inventors: Paul Abendroth; Josef Mathes, both of Offenbach am Main; Roland Höll, Weiterstadt, all of Fed. Rep. of Germany

[73] Assignee: MAN Roland Druckmaschinen, Fed. Rep. of Germany

[21] Appl. No.: 400,707

[22] Filed: Aug. 11, 1982

[30] Foreign Application Priority Data

Jul. 22, 1981 [DE] Fed. Rep. of Germany ..... 3128947

[51] Int. Cl.[4] ..... B41F 71/04

[52] U.S. Cl. ..... 101/246; 101/409; 271/276

[58] Field of Search ..... 101/229, 230, 231, 246, 101/409, 410, 411, 412, 407 A, 382 MV; 271/196, 276, 277, 82

[56] References Cited

U.S. PATENT DOCUMENTS

| | | | |
|---|---|---|---|
| 3,096,088 | 7/1963 | Young | 271/51 |
| 3,125,022 | 3/1964 | Reinartz et al. | 101/183 |
| 3,430,946 | 3/1969 | Seibke | 271/277 |
| 3,937,142 | 2/1976 | Cerny et al. | 101/409 |
| 4,014,261 | 3/1977 | Becker | 101/410 X |
| 4,024,814 | 5/1977 | Becker | 101/410 |
| 4,120,492 | 10/1978 | Cerny | 271/277 |
| 4,127,265 | 11/1978 | Wirz et al. | 101/409 X |
| 4,145,040 | 3/1979 | Huber | 271/196 X |
| 4,378,734 | 4/1983 | Wirz | 101/230 |

FOREIGN PATENT DOCUMENTS

| | | |
|---|---|---|
| 1155145 | 10/1963 | Fed. Rep. of Germany . |
| 1611241 | 5/1972 | Fed. Rep. of Germany . |
| 2354418 | 5/1975 | Fed. Rep. of Germany . |
| 2452096 | 7/1975 | Fed. Rep. of Germany . |
| 2736141 | 2/1978 | Fed. Rep. of Germany . |

*Primary Examiner*—Charles A. Pearson
*Attorney, Agent, or Firm*—Leydig, Voit & Mayer

[57] ABSTRACT

A sheet transfer drum for a recto and verso printing press having a two-piece section device, each piece being mounted on a diagonal slide, the slides being angled in opposite directions, so that the two pieces hold the two corners of the trailing edge of the sheet and stretch the corners in opposite axial directions as well as the circumferential direction of the sheet transfer drum. The stretching of the sheet is synchronized to the rotation of the transfer drum and effected by a control cam cooperating with a cam fixed to the printing press frame. The suction of the suction device is synchronized to rotation of the transfer drum by a commuting air connection between the suction device and a source of suction external to the press frame. The suction device is also adjustably mounted to the shaft of the transfer drum so that sheets of various length may be stretched. The shaft is hollow and encircles concentric control shafts which permit manual operation of internal adjusting and locking mechanisms from outside of the press frame.

12 Claims, 3 Drawing Sheets

SHEET TRANSFER DRUM FOR A PRINTING PRESS

In printing presses which print on both sides of a sheet, typically the sheet is temporarily stored on a transfer drum immediately prior to the sheet being turned over. In the case of recto and verso printing and particularly on switchable presses, it is necessary to guide the rear edge of the sheet in an accurate and precisely controlled fashion because the rear edge becomes the front edge after turning on the transfer drum. The leading edge of the sheet is conventionally secured to the transfer drum by grippers and the trailing edge is stretched in a direction opposite to the rotation of the transfer drum by a suction device. When the sheet is in its stretched condition, it is much easier for the trailing edge to be gripped by grippers on a cooperating cylinder and realigned so as to become the leading edge. Excessive register differences occurring when the sheet is turned unquestionably leads to waste and are therefore undesirable.

There are many known suction device designs which attempt to smoothly stretch the sheet on the transfer drum in order to promote exact register as the sheet is turned.

As disclosed in U.S. Pat. No. 3,096,088 by William G. Young issued July 2, 1963, suction head mounted on the shaft of the transfer drum is typically provided so that the suction head is movable in the circumferential direction during an initial adjustment to set the distance from the gripper to the suction head and thereby accomodate sheets of a predetermined length. Young further discloses suction-operated means for intermittently moving the suction head in a direction opposite to the cylinder rotation when the suction head is covered by the sheet so that the sheet is stretched onto the cylinder. Moreover, parts of the suction head towards the end of the cylinder are inclined in opposite directions towards their respective ends of the cylinder so that the sheet is also stretched in the axial direction.

Another method of stretching a sheet on a transfer drum is disclosed in German Application DE-PS No. 2 354 418. There the suction device incorporates flow ducts in the form of an open groove into which air is blown. The cross-section of the flow ducts widens in the direction opposite to rotation of the transfer drum so that the air flowing in them stretches the sheets in the direction of the air flow and also creates a vacuum which sucks the sheets onto the surface of the drum.

A suction device having controlled stretching of the sheet on the transfer drum in both the circumferential and axial directions is disclosed in German Application DE-PS No. 2 452 096. This suction device has rotary suckers with suctional areas incorporating eccentrically arranged suction holes near the trailing edge of the sheet to be stretched. The sheets are stretched by turning the rotary suckers against the direction of rotation of the drum. The rotation of the rotary suckers is effected by a drum cam fixed to the machine frame, cooperating with a push rod journaled to the transfer drum. The rotary suckers on opposite ends of the cylinder rotate in opposite directions so that the sheet is also stretched in the axial direction. But this particular suction device, effecting controlled stretching of the sheets in both the circumferential and axial directions, requires a large number of rotary suckers and is thus costly and subject to wear.

Hence, the general aim of the invention is to provide a sheet transfer drum with a suction device which reliably permits controlled stretching of the rear edge of the sheet in both the circumferential and axial directions.

Another object of the invention is to provide a suction device for a transfer drum which is economical and has only a few moving parts thus reducing wear and decreasing maintenance, yet at the same time providing controlled stretching of the sheet in both the axial and circumferential directions.

Another object of the invention is to provide a suction device on a transfer drum which controllably stretches the sheet in both the axial and circumferential directions and which is adjustable to accommodate sheets of various lengths. A related object is to provide means for manually adjusting the suction device for a predetermined sheet length, the adjustment being effected from outside of the press frame, thereby facilitating the adjustment.

Other objects and advantages of the invention will become apparent upon reading the following detailed description and upon reference to the drawings in which.

Figure 1:
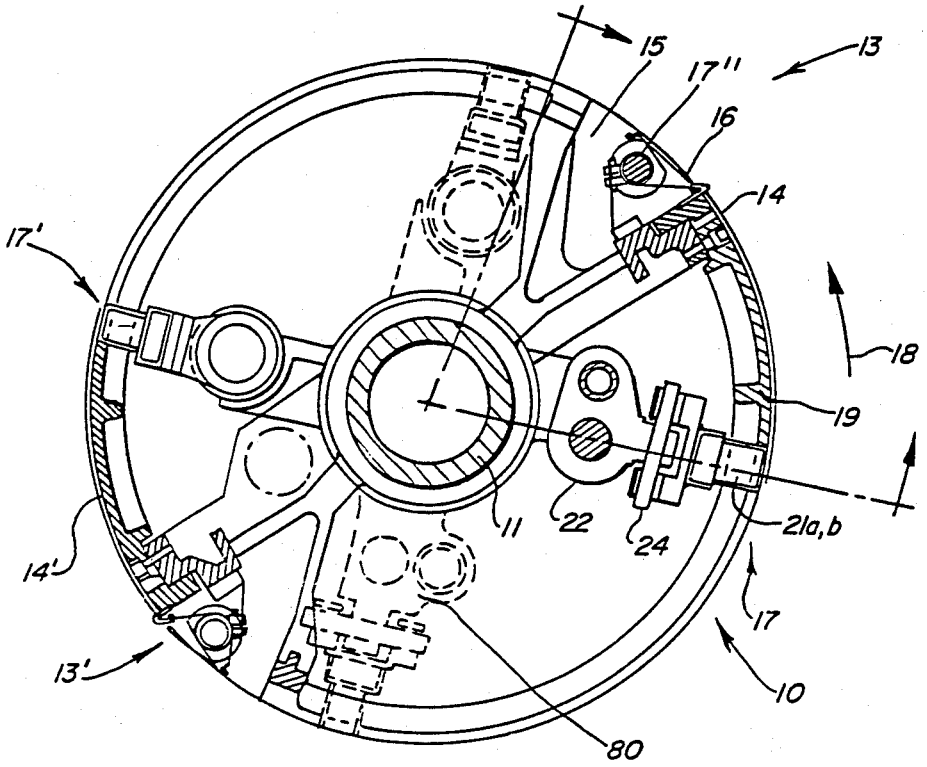
FIG. 1 is an end view in cross-section of the sheet transfer drum illustrating the relation between the gripper mechanism and the suction device.

While the invention is susceptible to various modifications and alternative forms, a specific embodiment thereof has been shown by way of example in the drawings and will herein be described in detail. It should be understood, however, that it is not intended to limit the invention to the particular forms disclosed, but, on the contrary, the intention is to cover all modifications, equivalents, and alternatives falling within the spirit and scope of the invention as defined by the appended claims.

Turning now to the drawings, there is shown in FIG. 1 an end view in cross-section of the sheet transfer drum according to the present invention. The sheet transfer drum, generally designated 10, has a hollow shaft 11 fixed to the drum and which is journalled at its ends to the press frame (12 FIG. 2) for rotation of the drum 10 with respect to the fixed press frame The sheet transfer drum 10 is also provided with a conventional gripper mechanism generally designated 13 for gripping the leading edge of the sheet 14. The gripper mechanism 13 is mounted in a recess 15 in the transfer drum and has a plurality of grippers 16 which rack on a shaft 17 " which has a cam follower (82 FIG. 2) cooperating with a cam (81 FIG. 2) mounted on the press frame 12.

Typically the sheet transfer drum is also provided with a sucker device generally designated 17 for securing the trailing edge of the sheet 14 and intermittently moving in a direction opposite to the direction of the cylinder rotation 18 in order to stretch the sheet 14 flat against the outer shell 19 of the transfer drum 10. It should be noted that in a printing press which prints on both sides of the sheet, a transfer drum such as the drum 10 is used to temporarily store the sheet 14 so that a cooperating cylinder (not shown) with grippers (not shown) may grip the trailing edge of the sheet 14 and thereby reverse it, with the trailing edge of the sheet 14' on the transfer drum becoming the leading edge for further printing on the unprinted side of the sheet 14. The transfer drum 10 in FIG. 1 is also shown as a sheet transfer drum of double size, so that two sheets may be temporarily stored. For storage of the second sheet 14' a second gripper mechanism 13' and suction device 17' is also built into the transfer drum 10.

Figure 2:
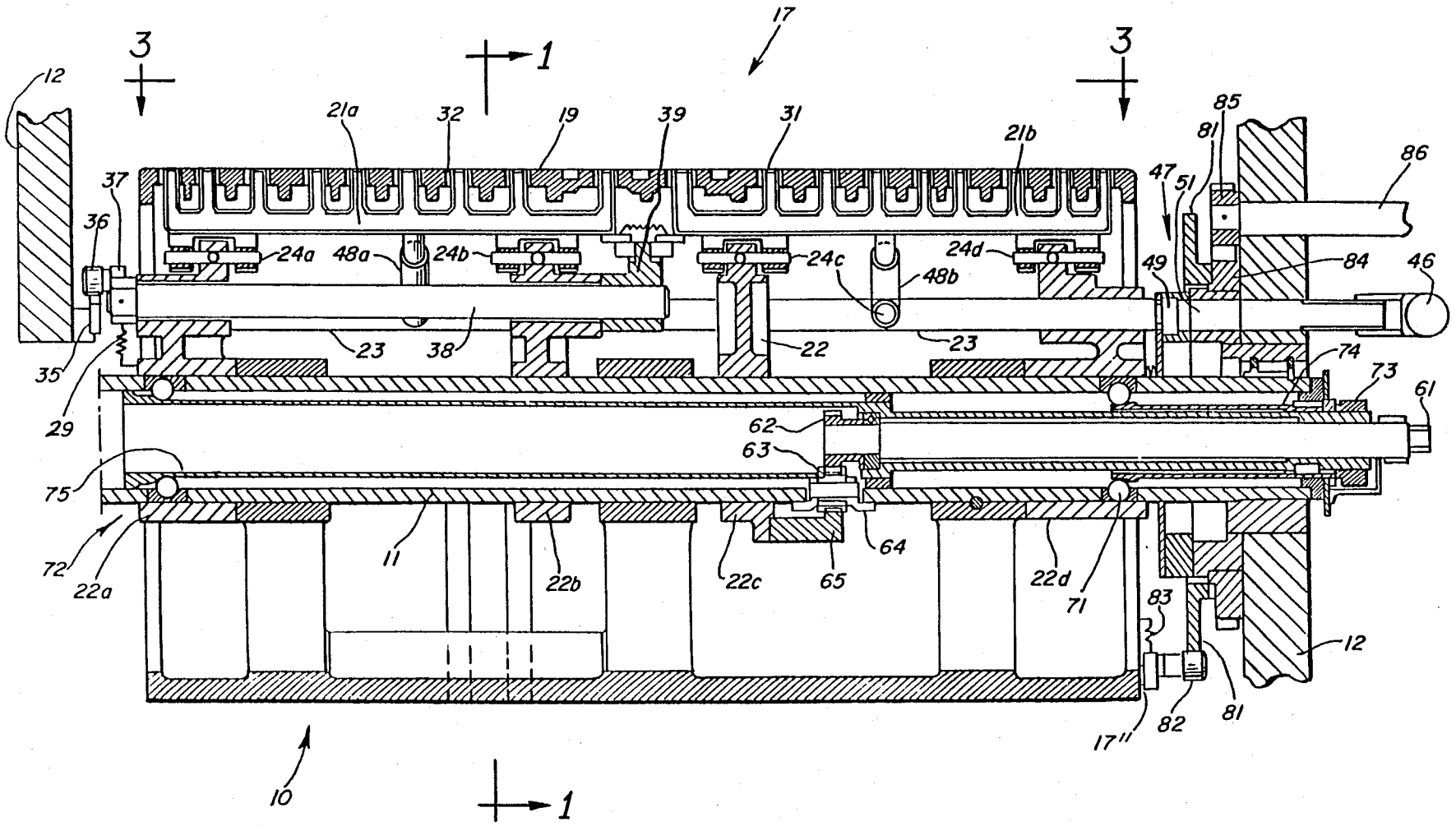
FIG. 2 is a longitudinal section of the sheet transfer drum through the suction device and the manual sheet-length adjustment and locking mechanism.

In accordance with an important feature of the present invention, the suction device 17 has a pair of suckers 21*a*, 21*b*, each sucker being offset from the center of the transfer drum towards opposite ends of the cylinder, as shown in FIG. 2. The suckers 21*a*, 21*b* are mounted on a sucker support 22 which is journalled to the hollow shaft 11 of the transfer drum 10. It should be noted that the sucker support has a number of journalling parts 22*a*, 22*b*, 22*c*, 22*d* which are interconnected, for example by the suction pipe 23, to form the sucker support 22. The suckers 21*a*, 21*b* are mounted on the parts 22*a*, 22*b*, 22*c*, 22*d* of the sucker support 22 by means of diagonal slides 24*a*, 24*b*, 24*c*, 24*d*, respectively.

Figure 3:
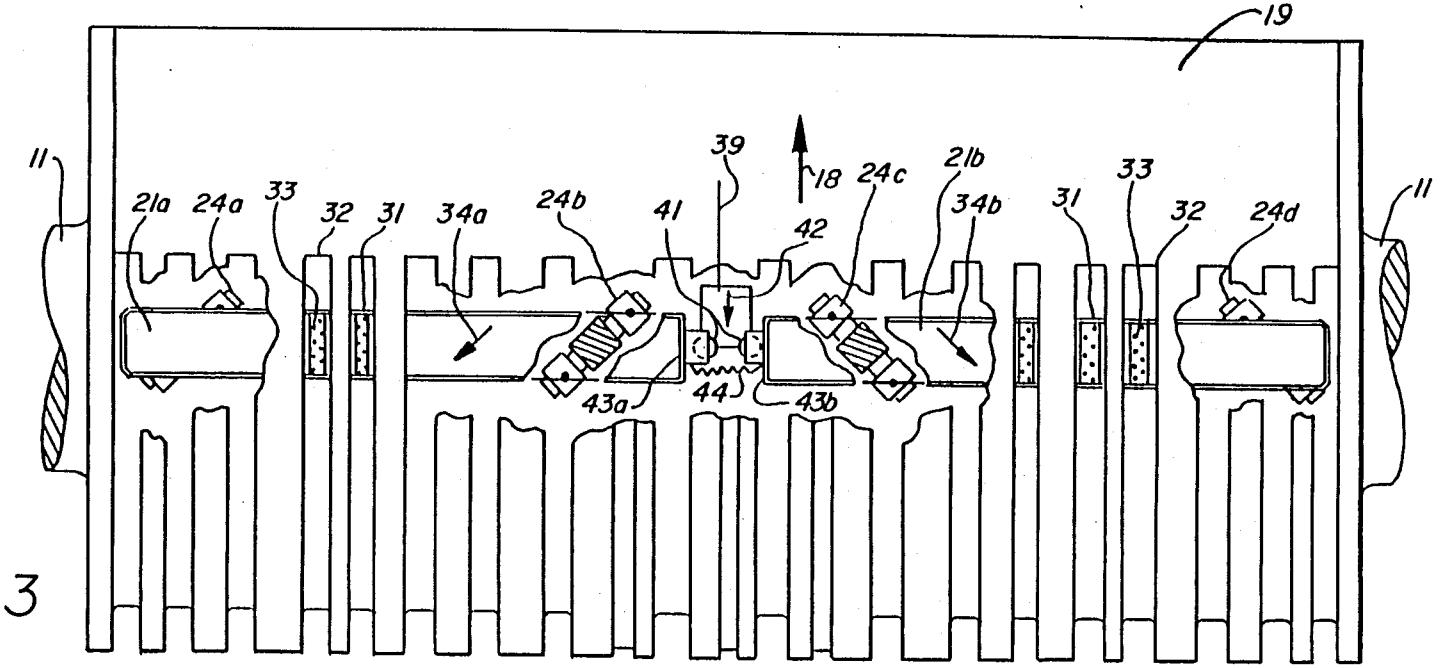
FIG. 3 is a partial plan view corresponding to FIG. 2.
Figure 4A:
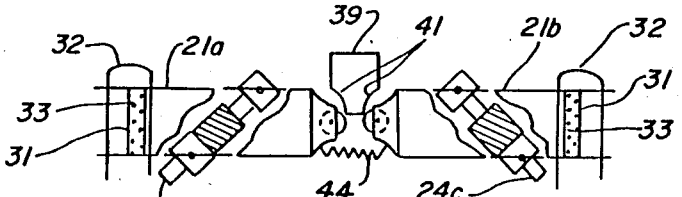
FIG. 4A and FIG. 4B are stopped-motion views of the slide mechanism illustrating the limits of the circumferential and axial displacement of the suction device.
Figure 4B:
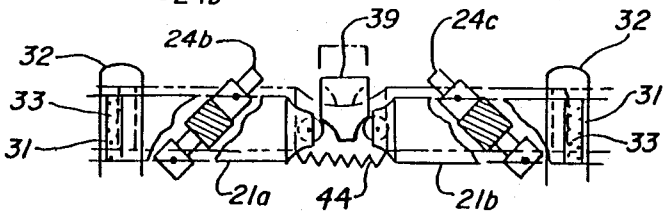

The diagonal direction of motion of the suckers is best shown in FIG. 3 and FIG. 4A and 4B. Each of the suckers has a number of fingers 31, which are disposed within apertures 32 in the shell 19 of the transfer drum 10. These fingers have a flat surface perferated with a number of holes 33 leading to vacuum chambers inside the suckers 21*a*, 21*b*. The surfaces of the suckers are approximately flat with the outer cylindrical surface of the shell 19. Thus when the trailing edge of the sheet 14 is placed over the fingers 31 of the suckers 21*a*, 21*b*, the trailing edge adheres to the outer flat surface of the fingers 31. At this time the suckers are in the position shown in FIG. 4A with respect to the apertures 32 of the shell 19. At a pre-determined time (after the sheet 19 has been fed with its trailing edge over the suckers 21*a*, 21*b*) the suckers are caused to move in diagonal directions 34*a*, 34*b* to the intermediate positions shown in FIG. 3 on their way to a final position shown in FIG. 4B. Since each of the suckers is generally rectangular and elongated and has a diagonal slide at each end, each sucker 21*a*, 21*b* is maintained in a cylindrical plane with respect to the transfer drum and with the longitudinal axes of the suckers 21*a*, 21*b* being aligned in the axial direction. The apertures 32 are of sufficient size to permit this intermittent diagonal motion of the suckers 21*a*, 21*b*. The diagonal slides 24*a*, 24*b*, 24*c*, 24*d* are of conventional construction wherein roller bearings are used to reduce friction and wear.

The sliding axes of the guide 24*a*, 24*b*, 24*c*, 24*d* for each respective guide are parallel. But the axes for the guides 24*a*, 24*b* for the left-hand sucker 21*a* are skewed at an acute angle with respect to the circumferential direction of drum rotation in a direction opposite to the acute angle of skew of the axes of the guides 24*c*, 24*d* associated with the right-hand sucker 21*b*. Thus the diagonal axes of relative movement of the guide are skewed oppositely so that circumferential motion of the suckers 21*a*, 21*b* in a common direction with respect to the drum requires motion of the suckers 21*a*, 21*b* in opposite axial directions. In practice, this means that when the suckers 21*a*, 21*b* are moved in unison in a direction opposite to the direction of drum rotation in order to stretch the sheet 14 circumferentially, the left-hand corner of the sheet is displaced axially towards the left-hand end of the drum while the right-hand corner of the sheet 14 is displaced toward the right-hand end of the drum, thereby also stretching the sheet 14 in the axial direction.

In accordance with an important feature of the invention, the intermittent motion of the suckers 21*a*, 21*b* and the common circumferential direction opposite to cylinder rotation is effected by a control cam 35 fixed to the press frame 12 (FIG. 2) so that the stretching of the sheet 14 is synchronized to the rotation of the transfer drum relative to the press frame 12. A follower 36 cooperates with the cam 35 and is disposed on the end of a lever arm 37 pivoting and secured to a rocker shaft 38 journalled to the left-hand parts 22*a*, 22*b* of the sucker support 22. A biased spring 29 is used to insure that the follower 36 tracks the cam 35. The cam arrangement synchronizes the motion of the swiveling shaft 38 with the rotation of the transfer drum with respect to the press frame 12.

The right-hand end of the swiveling shaft 38 is fixed to a rocker arm 39 terminating in a dual segment cam 41. The fixed cam 35 has a profile chosen so that the dual segment cam 41 is intermittently driven circumferentially in a direction 42 opposite to the direction of cylinder rotation 18. Cam followers 43*a*, 43*b* are provided on the central ends of the suckers 21*a*, 21*b* to resolve the intermittent circumferential motion of the dual segment cam 41 to motion of the suckers 21*a*, 21*b* in the diagonal directions 34*a*, 34*b*, respectively. At least one biased spring, such as the extension spring 44 bridging the central ends of the suckers 21*a*, 21*b* is provided for insuring that the followers 43*a*, 43*b* track the dual segment cam 41. Of course, springs for this purpose may be attached anywhere to the suckers 21*a*, 21*b*, for example, at their outer ends.

According to another feature of the present invention, the axial stretching of the sheet is maximized by having the degree of suction be a function of axial position, with the suction being a minimum near the center of the transfer drum and a maximum near the ends of the transfer drum. As shown in FIG. 3, the spacing between the suction fingers 31 and their aligned apertures 32 is greatest near the center of the cylinder and a minimum near the ends of the cylinder. Thus the suction is a minimum near the center because there are relatively less suction fingers located there. Moreover the number of suction holes per suction finger is a minimum for the suction fingers near the center of the cylinder and a maximum for the suction of fingers near the ends of the cylinder. Thus, the number of suction holes per suction fingers increases from the center of the sheet transfer drum to the ends of the drum.

In accordance with another important feature of the present invention, the vacuum for the suckers 21*a*, 21*b* is provided by a source of suction 46 external to the press frame 12 and an air connection 47 is provided between the press frame and the suction pipe 23 at the right-hand end of the transfer drum 10. The suction pipe 23 is interconnected to the suckers 21*a*, 21*b* by flexible hoses 48*a*, 48*b*. Moreover, the air connection 47 is a means for mechanically commutating the suction supply to the suckers 21*a*, 21*b*, thereby turning on the suction only when it is needed. The commutation results from the fact that the air connection 47 is between a rotating part 49 engaging with a fixed part 51 and arcuate connecting apertures in the rotating part 49 and fixed part 51 index only over a limited range of angular positions.

In accordance with another important feature of the invention, the sucker support 22 (and thus also the suckers 21*a*, 21*b*) may rotate on the hollow shaft 11 in relation to the shell 19 and thus the sucker support 22 can be adjusted to accomodate a specific sheet size. Moreover, means are provided for adjusting the angular relation of the sucker support 22 with respect to the transfer drum 10 and for locking the sucker support 22 into a fixed angular position after the adjustment is made, and these adjustments may be made manually from outside of the press frame 12. To adjust for the sheet size, a central shaft 61 is provided with an internal gear 62 meshing with an idler gear 63 journalled to a small housing 64 disposed in an aperture in and affixed to the hollow shaft 11 of the transfer drum. An arcuate rack 65 external to and arcing around the hollow shaft engages with the idler gear 63 and is also affixed to the part 22*c* of the sucker support 22. Thus the angular position of the sucker support 22 may be adjusted by manually turning the external end of the central shaft 61.

To lock the sucker support 22 into a fixed angular position about the hollow shaft 11, radial clamps generally designated 71, 72 of known construction are provided. These radial clamps are actuated by a pair of hollow shafts 74, 75 within the hollow shaft 11 of the transfer drum, and the clamping and unclamping is manually effected external to the press frame by rotation of the threaded collar 73 which causes a relative axial displacement of the hollow shaft 74 of the radial clamp 71 with respect to the hollow shaft 75 of the radial clamp 72. This relative axial displacement generates the locking force exerted on the internal surfaces of the sucker support parts 22*a*, 22*d*.

To accommodate a wide variation in the angular position of the sucker support 22 with respect to the transfer drum 10 and thus accommodate a wide range of sheet sizes, the apertures 32 of the shell 19 arc over a wide range, approximately 90°, as shown in FIG. 1 and FIG. 3. Then the sucker support 32 and suckers 21*a*, 21*b* may be adjusted from the minimum sheet size position shown in FIG. 1 to the maximum sheet size position 80 shown in phantom lines in FIG. 1.

It should be noted that the grippers 13 and 13' typically must be opened at different times for different sized sheets. .For this purpose, the gripper cam 81 is movably mounted to the press frame 12. The gripper shaft 17 is operated by the cam 81 in the conventional manner, using a follower 82 pivotally attached to the shaft 17 and urged by a biased spring 83 to track the cam. But the cam 81 is secured to a ring 84 journalled for rotation about the axis of the transfer drum. The ring 84 has spur gear teeth to mesh with a pinion 85 fixed on an adjustment shaft 86, the shaft 86 being accessible from outside of the press frame for effecting the phase adjustment of the gripper cam 81.

In view of the above, it is apparent that all of the adjustments required for accommodating a specific sheet size within a predetermined range of sheet sizes may be conveniently performed from outside of the press frame 12 by adjustment of the locking collar 73, the central angle positioning shaft 61, and the gripper phase adjusting shaft 86.

From the foregoing, a sheet transfer drum has been disclosed having a reliable and economic slide mechanism for controlled stretching of the trailing edge of the sheet in both the axial and circumferential directions. An external source of suction is conserved by a cummutating air connection and judicious placement of suction fingers and holes maximize the stretching effect for the available vacuum level. Moreover, the sheet transfer drum may accommodate sheets of varying sizes and connections from outside of the press frame to the inside of the drum are provided to facilitate the adjustments for a given sheet size.

What is claimed is:

1. A sheet transfer drum for a printing press comprising, in combination a cylinder journalled on the press frame for relative rotation about a central axis, a sheet gripper secured to the cylinder for securing the leading edge of a generally rectangular sheet to the surface of the cylinder with the leading edge of the sheet generally parallel to the cylinder axis, a pair of suckers each having a suction surface near the cylinder surface for applying suction force to the trailing edge of the sheet and adhering the trailing edge of the sheet to the suckers, said suckers each being offset from the center of the cylinder towards the end of the cylinder opposite the other sucker, a sucker support within said cylinder for supporting the suckers at a generally predetermined angular position about the cylinder axes with respect to the sheet gripper, a pair of guides disposed on said sucker support having respective axes which are diagonally oriented with respect to the cylinder axis and skewed oppositely relative to each other for connecting the suckers to said sucker support and for guiding relative movement of the suckers in diagonal directions with respect to the cylinder axis with the diagonal directions of relative movement of the suckers being skewed oppositely so that circumferential motion of the suckers in a common circumferential direction with respect to the cylinder causes motion of the suckers in opposite axial directions, a glide member associated with each sucker for cooperation with said guides, and periodic cam-operated means for intermittently moving said suckers in a common circumferential direction at predetermined phases of the rotating cylinder with respect to the press frame so that the sheet is stretched by the intermittent motion of the suckers in both the circumferential and axial direction of the cylinder.

2. The sheet transfer drum as claimed in claim 1, wherein the periodic means for intermittently moving the suckers comprises a cam fixed to the machine frame, a rocking shaft generally parallel to the cylinder axis and journalled to the sucker support and having a pivot arm and cam follower at one end engaging the fixed cam, and a cam segment attached to the rocking shaft, engaging at least one of the suckers and effecting the diagonal movement of the suckers.

3. The combination as claimed in claim 1, further comprising a source of suction external from the press frame, and an air connection mounted on the inside of the press frame between the cylinder and the frame and connecting the source of suction to the suckers.

4. The combination as claimed in claim 3 wherein the air connection comprises mechanical means for commutating the suction connection between the source of suction and the suckers in the cylinder, providing a connection within a predetermined range of phase of the cylinder angle with respect to the press frame.

5. The combination as claimed in claim 1, wherein the cylinder comprises a cylinder shell defining the outer cylinder surface, the shell having a plurality of axially-spaced arcuate windows circumferentilly arcing with respect to the cylinder axis over each of the suckers, and wherein each sucker has a set of suction fingers aligned with the windows of the shell, each finger having a plurality of suction holes.

6. The combination as claimed in claim 5, wherein the number of suction holes in the suction fingers increases from the center of the cylinder outwards towards the ends of the cylinder.

7. The combination as claimed in claim 5, wherein there are at lest three suction fingers in each sucker and the spacing between the fingers near the center of the cylinder is greater than the spacing between the fingers near the ends of the cylinder.

8. A sheet transfer drum for a printing press comprising, in combination, a rotating cylinder journalled to the press frame, gripper means attached to the cylinder for securing the leading edge of a generally rectangular sheet to the surface of the cylinder, the leading edge being generally parallel to the cylinder axis, sucker means having a suction surface near the cylinder surface for employing suction force to the trailing edge of the sheet and adhering the trailing edge of the sheet to the sucker means, said angle adjustment means and angle locking means having operating means, comprising shafts within the hollow cylinder shaft, for effecting the manual adjustment and locking from outside of the press frame.

9. In a sheet transfer drum for a printing press having a set of grippers for securing the leading edge of a sheet to the drum and a suction device for securing the trailing edge of the sheet and stretching the sheet in a direction opposite to the rotation of the drum and also at right angles to the drum, with the corners of the trailing edge of the sheet being stretched towards the nearest respective end of the drum, the stretching being effected by at least one control cam phase-synchronized to rotation of the drum, wherein the improvement comprises:

a shaft coaxial with the axis of the transfer drum and secured to the ends of the drum, a sucker support rotatably mounted on the shaft and having means for adjusting the mounting angle and locking the sucker support to a predetermined angular position on the shaft, the suction device having at least two parts moveably mounted on the sucker support, at least one first part mounted substantially to the left of center of the drum and at least one other second part mounted substantially to the right of the center of the drum, the two parts having adjacent end portions at the midsection of the transfer drum, the suction device having fingers with suction holes near the surface of the drum, at least one diagonal guide securely mounting each part of the suction device to the sucker support, the guide axes being diagonal to the axial and circumferential directions of the drum and lying approximately on a cylindrical surface with respect to the drum axis, so that the parts of the suction device are guided approximately along the drum surface in the axial and circumferential directions, the axes of the guides associated with the first part being skewed at an acute angle with respect to the circumferential direction of drum rotation in a direction opposite to the acute angle of skew cf the axes of the guides associated with the second part, at least one cam means operated by the relative rotation of the drum with respect to the press frame for effecting diagonal movement of at least the first and second parts of the suction device towards their respective opposite ends of the cylinders, so that the diagonal motion of the parts of the suction device are phase-synchronized to rotation of the drum, the drum having apertures in its cylindrical surface indexed with the fingers of the suction device, the apertures being axially wide enough to accommodate the axial motion of the fingers effected by the associated cams, and the apertures being circumferentially long enough to accommodate the circumferential motion of the finger effected by the associated cams and to accommodate a substantial range of the angular adjustment of the mounting angle of the sucker support on the shaft, so that sheets of various predetermined lengths lying on the surface of the drum, their leading edges secured by the grippers and their trailing edges secured to the suction device by suction generated within the apertures of the drum, are stretched, the corners of the trailing edge of the sheets being stretched diagonally towards opposite ends of the drum wherein the cam means comprises a cam fixed to the machine frame, a rocking shaft generally parallel to the cylinder axis and journaled to the sucker support means and having a pivot arm and cam follower at one end engaging the fixed cam, and a cam segment attached to the rocking shaft by a rocker arm at the midsection of the cylinder and engaging the adjacent end portions of the two parts of the suction device.

10. The sheet transfer drum as claimed in claim 9, wherein the number of suction holes in the suction fingers of the suction device increases from the center of the sheet transfer drum outwards toward the ends of the drum.

11. The sheet transfer drum as claimed in claim 9, further comprising a source of suction external to the press frame and an air connection between the press frame and the drum, the suction device being supplied by the source of suction through the air connection.

12. A sheet transfer drum for a printing press comprising, in combination, a rotating cylinder journalled to the press frame, gripper means attached to the cylinder for securing the leading edge of a generally rectangular sheet to the surface of the cylinder, the leading edge being generally parallel to the cylinder axis, a pair of sucker means having a suction surface near the cylinder surface for employing suction force to the trailing edge of the sheet and adhering the trailing edge of the sheet to the sucker means, each sucker means being offset from the center of the cylinder, towards the end of the cylinder opposite the other sucker means, sucker support means connected to the sucker means for securing the sucker means to the cylinder at a generally predetermined angular position about the cylinder axis with respect to the gripper means, a pair of diagonal guide means each for connecting an associated sucker means to the sucker support means and for guiding relative diagonal movement, in both the circumferential and axial directions, of the sucker means with respect to the sucker support means, the diagonal axes of relative movement of the guides being skewed oppositely so that circumferential motion of the sucker means in a common circumferential direction with respect to the cylinder requires motion of the sucker means in opposite axial directions, and periodic cam-operated means for intermittently moving each of the sucker means in a common circumferential direction at predetermined times generally at predetermined phases of the rotating cylinder with respect to the press frame, so that the sheet is stretched by the intermittent motion of the sucker means in both the circumferential and axial direction of the cylinder, wherein the cylinder is fixed to a hollow shaft journalled to the press frame, and wherein the sucker support means has means to secure the sucker means to the cylinder at any predetermined angular position within a predefined range of angular positions, and further comprising manual angle adjustment means for establishing an angular position, and manual angle locking means for fixing the established angular position, said manual angle adjustment and locking means having operating means, comprising shafts within the hollow shaft, for effecting the manual adjustment and locking from outside of the press frame.

* * * * *